US009221482B2

(12) United States Patent
Gatterbauer et al.

(10) Patent No.: US 9,221,482 B2
(45) Date of Patent: Dec. 29, 2015

(54) TRANSPORTING SYSTEM, TRANSPORTING CARRIAGE AND METHOD FOR TRANSPORTING METAL COILS

(75) Inventors: Roland Gatterbauer, Linz (AT); Roland Hofer, Reichenau (AT)

(73) Assignee: SIEMENS VAI METALS TECHNOLOGIES GMBH (AT)

( * ) Notice: Subject to any disclaimer, the term of this patent is extended or adjusted under 35 U.S.C. 154(b) by 301 days.

(21) Appl. No.: 13/880,951

(22) PCT Filed: Sep. 27, 2011

(86) PCT No.: PCT/EP2011/066719

§ 371 (c)(1),
(2), (4) Date: Apr. 22, 2013

(87) PCT Pub. No.: WO2012/052259

PCT Pub. Date: Apr. 26, 2012

(65) Prior Publication Data

US 2013/0206923 A1 Aug. 15, 2013

(30) Foreign Application Priority Data

Oct. 22, 2010 (EP) ..... 10188451

(51) Int. Cl.

| | |
|---|---|
| ***B61L 27/00*** | (2006.01) |
| ***B21C 47/24*** | (2006.01) |
| ***B61B 13/12*** | (2006.01) |
| ***B61J 1/04*** | (2006.01) |

(52) U.S. Cl.

CPC ..... *B61L 27/00* (2013.01); *B21C 47/24* (2013.01); *B61B 13/12* (2013.01); *B61J 1/04* (2013.01)

(58) Field of Classification Search

CPC ..... B61L 27/00; B61L 5/005; B61J 1/04; B61B 13/12; B61B 3/02; B21C 47/24; B61D 45/003; B61C 13/00

See application file for complete search history.

(56) References Cited

U.S. PATENT DOCUMENTS 3,460,684 A * 8/1969 Almasy ..... 410/49
3,658,011 A * 4/1972 West et al. ..... 410/45

(Continued)

FOREIGN PATENT DOCUMENTS

CN 101025632 A 8/2007
CN 101108694 A 1/2008

(Continued)

OTHER PUBLICATIONS

International Search Report, Application No. PCT/EP2011/066719, 3 pages, Jan. 18, 2012.

(Continued)

*Primary Examiner* — Jason C Smith
(74) *Attorney, Agent, or Firm* — Ostrolenk Faber LLP

(57) ABSTRACT

A transporting system for transporting metal coils, for example hot coils, may include a multi-track rail system; a number of driverless transporting carriages, which can be moved on the rail system by means of a drive device and are equipped with an on-board communication device; a locating device, with which up-to-the-moment locational information can be determined for each transporting carriage located on the rail system; and a central control device, to which the locational information of each transporting carriage can be fed, wherein a communication link, which at least in certain sections is formed without any lines, can be established between the control device and the communication device.

24 Claims, 4 Drawing Sheets

(56) References Cited

U.S. PATENT DOCUMENTS

| | | | | |
|---|---|---|---|---|
| 3,922,004 | A * | 11/1975 | Chamberlain | 410/49 |
| 5,170,717 | A * | 12/1992 | Richmond et al. | 105/377.09 |
| 5,191,842 | A * | 3/1993 | Tinkler | 105/355 |
| 5,622,116 | A * | 4/1997 | Carlton | 105/355 |
| 6,039,284 | A * | 3/2000 | Lehrieder et al. | 242/559 |
| 6,176,670 | B1 * | 1/2001 | Salsburg | 414/391 |
| 6,213,025 | B1 * | 4/2001 | Sauerwein et al. | 104/121 |
| 6,363,864 | B1 * | 4/2002 | Jamrozy et al. | 105/418 |
| 6,619,213 | B2 * | 9/2003 | Militaru et al. | 105/404 |
| 6,749,381 | B2 * | 6/2004 | Coslovi et al. | 410/49 |
| 7,232,020 | B2 * | 6/2007 | Futschek | 191/10 |
| 7,815,404 | B2 * | 10/2010 | DeMent | 410/49 |
| 7,972,098 | B2 * | 7/2011 | DeMent | 410/49 |
| 8,672,594 | B1 * | 3/2014 | West | 410/35 |
| 2002/0073884 | A1 * | 6/2002 | Al-Kaabi et al. | 105/355 |
| 2008/0253854 | A1 * | 10/2008 | Anderson | 410/49 |
| 2011/0248141 | A1 * | 10/2011 | Lee | 248/346.5 |
| 2012/0187091 | A1 * | 7/2012 | Grzyb et al. | 219/69.1 |
| 2012/0317774 | A1 * | 12/2012 | Baumer | 29/426.2 |
| 2013/0020179 | A1 * | 1/2013 | Holloway | 198/574 |
| 2013/0071223 | A1 * | 3/2013 | Cramer et al. | 414/800 |
| 2013/0206923 | A1 * | 8/2013 | Gatterbauer et al. | 246/186 |
| 2013/0214078 | A1 * | 8/2013 | Jesche et al. | 242/363 |
| 2014/0013995 | A1 * | 1/2014 | Kutschera | 105/378 |

FOREIGN PATENT DOCUMENTS

| | | | | |
|---|---|---|---|---|
| DE | 19626966 | A1 | 1/1998 | B61B 13/06 |
| DE | 19637771 | A1 | 3/1998 | B65G 1/00 |
| DE | 102005008555 | A1 | 8/2006 | G05D 1/03 |
| EP | 0061557 | A2 | 10/1982 | B21C 47/24 |
| JP | 10119784 | A | 5/1998 | B21C 47/24 |
| KR | 2003-0006922 | | 1/2003 | |
| RU | 2 070 453 | C1 | 12/1996 | |
| WO | 03/026915 | A1 | 4/2003 | B60L 5/00 |
| WO | 2009/153050 | A1 | 12/2009 | B60L 5/00 |
| WO | 2012/052259 | A1 | 4/2012 | B21C 47/24 |

OTHER PUBLICATIONS

Russian Federation Decision on Grant, dated Sep. 24, 2015, issued in corresponding Russian Patent Application No. 2013123350/02(034401). Total 9 pages.

Korean Office Action, dated Sep. 24, 2015, issued in corresponding Korean Patent Application No. 10-2013-7012986. Total 5 pages.

* cited by examiner

TRANSPORTING SYSTEM, TRANSPORTING CARRIAGE AND METHOD FOR TRANSPORTING METAL COILS

CROSS-REFERENCE TO RELATED APPLICATIONS

This application is a U.S. National Stage Application of International Application No. PCT/EP2011/066719 filed Sep. 27, 2011, which designates the United States of America, and claims priority to EP Patent Application No. 10188451.8 filed Oct. 22, 2010. The contents of which are hereby incorporated by reference in their entirety.

TECHNICAL FIELD

The disclosure relates to a transporting system, a transporting carriage and a method for transporting metal coils, in particular hot coils.

BACKGROUND

It is known that transporting vehicles are used in the manufacture and also in the preparation of metal coils, for example, in order to transport the metal strip that has been wound up into a truss, also known as a coil, away from winding and towards various preparation stations. In the individual preparation stations, the metal coils are further prepared, for example bound, marked, weighed and inspected, before they come to a storage or loading station. A hot coil coming off a rolling mill normally has a temperature of up to 850° C. and a weight of up to 45 t. For this, various conveyors are used, such as rail vehicles, so-called coil-transporting carriages, short transporting carriages, chain and lifting beam conveyors, all of which are often very complex to construct and also to operate.

In mills, transporting carriages normally move along a track, which is anchored to the foundations of the factory. The rail system may consist essentially of straight-running track sections. At crossing points, a turntable makes changes of direction of travel possible with regards to the approach of track sections facing other directions.

In modern hot coil lines, short coil intervals are increasingly becoming a problem, as the station times are getting shorter and shorter. Known conveyors can hardly achieve a coil removal rate of less than a minute and are furthermore not very flexible. There is therefore a need for a transporting system that has a better availability and greater flexibility.

Moreover, in known transporting systems, damage often occurs to the coils because of the short station times for picking up and dropping off the metal coils due to the demands of lifting. The manufacturing quality of the metal strip is thereby adversely affected.

SUMMARY

One embodiment provides a transporting system for transporting metal coils, in particular hot coils, comprising: a multi-track rail system; several driverless transporting carriages, which can be moved on the rail system by means of a drive device and are equipped with an on-board communication device; a locating device, with which current location information can be ascertained for each transporting carriage located on the rail system; and a central control device, to which the location information of each transporting carriage can be conveyed, wherein a communication connection, which at least in certain sections is embodied wirelessly, can be established between the control device and each communication device.

In a further embodiment, the communication connection is established via at least one leaky waveguide arranged on the line side.

In a further embodiment, the at least one leaky waveguide is connected to a base station by means of electric connections.

In a further embodiment, the locating device is a line-conducted position sensor.

In a further embodiment, the position sensor is formed by a reading head arranged on the vehicle side and a code rail arranged on the line side.

In a further embodiment, the code rail is coded with an absolute path coding.

In a further embodiment, the rail system is formed of two tracks, wherein loaded transporting carriages are allocated to a first rail track and unloaded carriages are allocated to a second rail track.

In a further embodiment, the drive device is an electric motor controlled by power electronics, the energy provision of which is established by means of a contact line arranged on the line side.

In a further embodiment, the transporting system comprises at least one push station, by means of which a transporting carriage can be pushed between the first rail track and the second rail track or from one of the rail tracks into a parked position.

In a further embodiment, the transporting system comprises at least one turntable by means of which the direction of motion of a transporting carriage on one of the rail tracks can be changed.

Another embodiment comprises a method for transporting metal coils, in particular hot coils, which can be transported on a multi-track rail system by means of a driverless transporting carriage driven by a drive device, comprising the following steps: ascertainment of location information of each transporting carriage by means of a locating device; transfer of this location information to a central control device; generation of control information in order to control the drive device through the central control device, wherein the location information of at least one of the transporting carriages located on the rail system is taken into consideration; establishment of a communication connection between the central control device and at least one communication device arranged on board; and transmission of the control information from the control device to the at least one communication device arranged on board, wherein transmission is carried out via the communication connection, which is embodied at least in one section as a radio connection.

In a further embodiment, the communication connection is established via at least one leaky waveguide arranged on the line side.

In a further embodiment, the communication connection is established via at least one leaky waveguide with attached base station.

In a further embodiment, the locating device is formed from a line-conducted position sensor.

In a further embodiment, the location information about a transporting carriage is optoelectronically scanned by means of a reading head arranged on the vehicle side and a code rail arranged on the line side.

In a further embodiment, the reading head scans a code rail with an absolute path coding.

In a further embodiment, a two-track rail system is used, wherein loaded transporting carriages are allocated to a first rail track and unloaded carriages are allocated to a second rail track.

In a further embodiment, an electric motor controlled by power electronics is used as a drive device, the energy of which is conveyed by means of a contact line arranged on the line side.

In a further embodiment, a push station is used, by means of which a transporting carriage can be pushed between the first rail track and the second rail track or from one of the rail tracks into a parked position.

In a further embodiment, the central control device allocates a logical channel to each communication device of a transporting carriage.

Another embodiment provides a driverless rail transporting carriage for transporting metal coils, in particular hot coils, which can be conveyed by means of a drive device on a multi-track rail system, wherein an on-board communication device, which is set up for data transfer via a communication connection that is embodied wirelessly at least in certain sections, is allocated to the transporting carriage.

In a further embodiment, the communication device is embodied for radio communication with a leaky waveguide arranged on the line side.

In a further embodiment, the wireless communication connection can be established in a frequency range of 2.4 GHz or 5 to 6 GHz.

In a further embodiment, the transporting carriage comprises a vehicle chassis, which has a support saddle for receiving a metal coil, wherein for protection of an on-board device, in which the communication connection is contained, a heat shield is provided.

BRIEF DESCRIPTION OF THE DRAWINGS

Exemplary embodiments will be explained in more detail below based on the schematic drawings, wherein.

DETAILED DESCRIPTION

Figure 1:
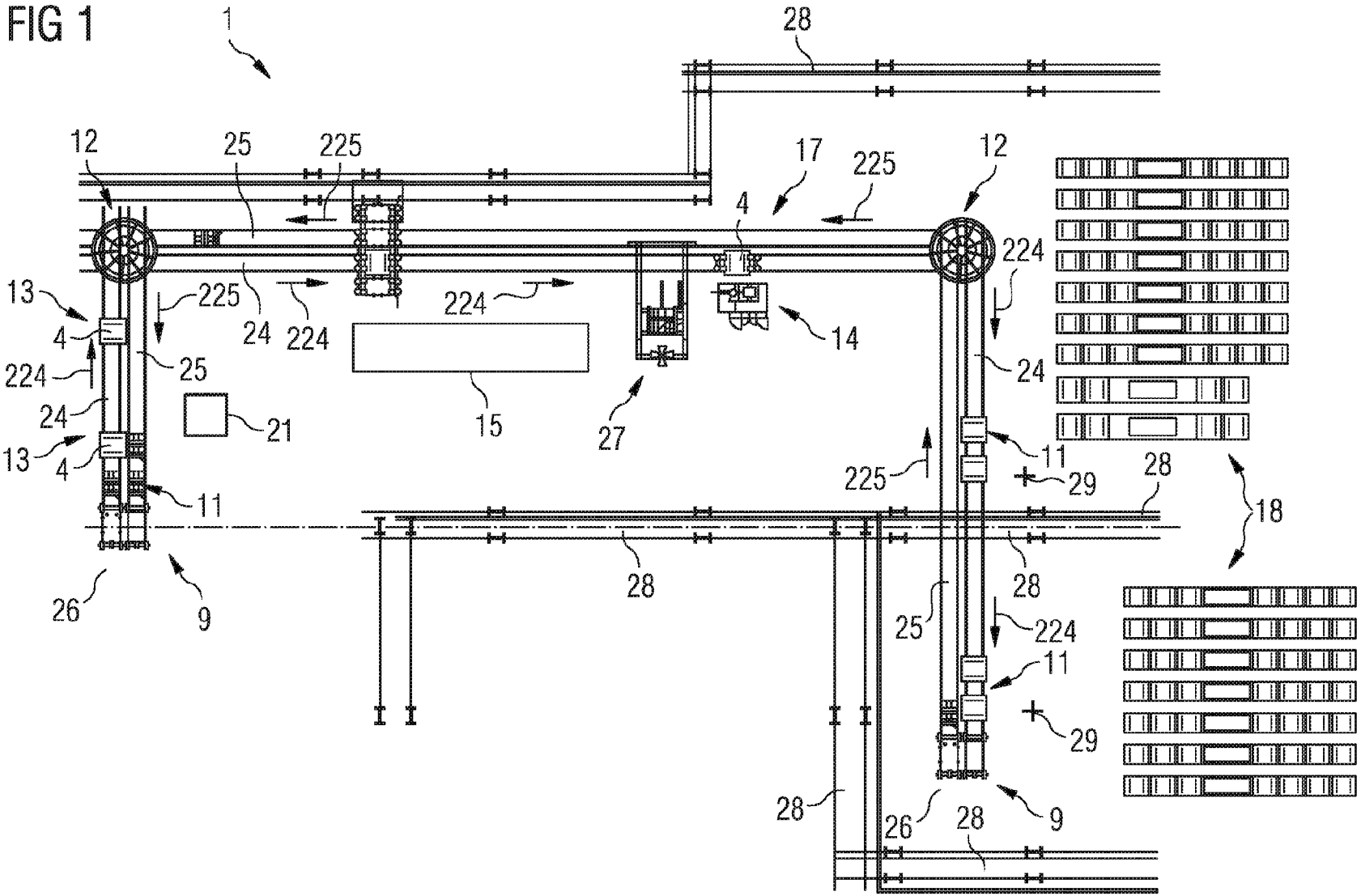
FIG. 1 a schematic depiction of an example embodiment as a coil-transporting system in a top-down view on the line route.

Embodiments of the present disclosure provide a device and a method for transporting metal coils, with the help of which transportation with greater availability and greater flexibility is possible and with which damage does not occur to the metal coils when the coil intervals are comparatively short.

Some aspects of the present disclosure are based on the concept of using several driverless transporting carriages for transporting metal coils, carriages which can be driven by means of a drive device on a rail system comprising at least two rail tracks, wherein each of these transporting carriages is equipped with a communication device, so that the transporting process can be controlled through transmission of control information that prepares a central control device taking into consideration the current location information of each transporting carriage, wherein the data transmission between the mobile communication device and the control device is at least in certain sections embodied wirelessly. In this way, the transportation can be controlled from a distance and has a high degree of availability and flexibility.

The transporting system may comprise:

- a multi-track rail system;
- several driverless transporting carriages, which can be moved on the rail system by means of a drive device and are equipped with an on-board communication device;
- a locating device, with which current location information can be ascertained for each transporting carriage on the rail system;
- a central control device, to which the location information of each transporting carriage can be conveyed, wherein a communication connection, which at least in certain sections is embodied wirelessly, can be established between the control device and the communication device.

The drive device can include, e.g., a mechanical gear, an electric motor with power electronics and possibly a control and regulating device. The communication device arranged on board can be formed e.g. by a radio module with an appropriate antenna. The locating device can work according to various principles, for example according to the principle of a field strength measurement, e.g. with several WLAN radio transmitters arranged in a factory, by means of which the location information is ascertained according to the principle of triangulation. The ascertainment of the location information can, however, also be carried out partially or fully by an on-board locating device. The communication device and the on-board locating device can advantageously be combined in a single on-board device. What is important is simply that the reception point of each transporting carriage can be ascertained by means of the locating device, and that this information can be conveyed to a control center. The communication device may be constructed in such a way that every carriage can communicate wirelessly with stationary transmission and reception devices. The transporting system may therefore make possible an allocation of the transporting carriages to the individual tracks of a multi-track rail system depending on the loading state. In this way the process of transportation can be controlled from a distance in such a way that adaptation to particular needs is possible. The central coordination of the transportation process moreover makes a higher degree of flexibility possible. The transporting system can act as a buffer or as temporary storage that makes it possible to temporarily divert conveyed material out of the transportation route. Upon diversion, the transported material can remain on the transportation carriage, e.g. if it is pushed along with a rail track segment, perpendicular to the transportation route. As the transported material no longer has to be grabbed by a multiplicity of differently-constructed transportation or conveyance devices, as was normal before now, the risk of damage is smaller. The accessibility and efficiency of the transportation system is thereby comparatively better.

In a preferred embodiment there can be provision for the wireless communication connection to be established via one or several leaky waveguides arranged on the line side. The transmission of information between a mobile communication device and fixed leaky waveguides is carried out through electromagnetic waves, the transmission and reception direction of which can be advantageously adapted to the spatial opportunities. Along the direction of transport, several of these leaky waveguides advantageously come into use. The technology of leaky waveguides known per se brings with it a range of advantages for the object definition present here, since it makes possible not only an undisturbed and no-wear transmission of information, but also a stable and secure data transfer under very harsh environmental conditions, such as prevail in steel production in factories and rolling mills. Devices that are widely available on the market can be used for wireless communication, for example such as are known for a local radio network according to the Standard Wireless Local Area Network (Wireless LAN, WLan, WLAN). WLAN-radio networks are described in IEEE-Standard of the family 802.11 and do not need to be further explained here. For the harsh everyday industrial environment of a rolling mill, Industrial Wireless LAN (IWLAN) Standard, such as is available commercially through SIMATIK NET components from Siemens, is particularly suitable.

It can be beneficial here if the at least one leaky waveguide is connected to a base station by signal line. In this way, integration is possible into a data network with a central control device that is arranged stationary in the network. This central control device can be e.g. a computer or a software platform that is divided between several computers. The control device knows about the whereabouts of each transporting carriage and can thereby react differently to unforeseen shortages. For example, should there be a delay or a shortfall in a processing or manufacturing station, then this does not have to lead to a bottleneck that limits the transporting process; rather, approaching transporting carriages can be diverted or excluded more easily than before. This increases the availability and efficiency of the transport system. Several coil transporting carriages can move simultaneously on a track section of a rail system, wherein the gap between the transporting carriages can be selected differently, e.g. according to how much strip material is accumulating at the coiler. This benefits the advantageous buffer action. Comparatively short coil intervals can be achieved. Leaky waveguides are, as previously described, component parts that are known per se, and are preferably used for undisturbed data communication for mobile participants that move on predefined sections, such as for example in a tunnel or in rail vehicles, e.g. along the path of travel of suspended monorails. The leaky waveguide technology makes undisturbed data exchange possible between a transporting carriage and a displaced stationary unit, such as e.g. one that is connected to the superordinate guidance system that coordinates transport process, e.g. SIMATIC®. Industrial Ethernet is particularly preferable here. In this way, integration into a superordinate, standardized data network and/or process guidance system is made possible, one that is robust with respect to data technology. The central device can e.g. take on an archiving function and also be arranged outside of the plant premises.

It can be of particular advantage if the locating device is formed by a position sensor. This position sensor can be embodied e.g. in such a way that a measuring system arranged on the carriage side continuously scans a landmark conveyed parallel to the rail line. Optical or inductive measuring principles can thereby come into use, for example.

In one embodiment the position sensor comprises a reading head arranged on the vehicle side, which optoelectronically scans a code rail arranged along the rail line.

In this connection, it can be especially advantageous if the code rail is coded with an absolute path coding. By this, it is not necessary to reach a zero point or a reference point in order to determine the current whereabouts of a transporting carriage.

According to one embodiment, the rail system is formed of two tracks. There are always several coil-transporting carriages on both rail tracks at the same time, which are each driven independently by the allocated drive unit, e.g. an electric drive. The two rail lines can be equipped with the absolute position sensor described above. Loaded transporting carriages are thereby always on a first rail track; unloaded ones on a second rail track. Each of these rail tracks is driven in only one direction of travel. This makes coordination easier and increases the flexibility of the transport system.

An embodiment in which the drive device is an electric motor, which is controlled e.g. by a power converter and wherein the energy provision takes place by means of a contact line embodied along the line, can be advantageous. Energy input via a contact line or contact rail running parallel to the direction of travel is sufficiently well known from conventional rail vehicles. Here, there is an opportunity to convey the contact rail together with the code rail of the position sensor in a protected channel. In this way, the code rail is well protected against mechanical effects.

In order to further improve the flexibility of the transport system, it can be advantageous if so-called handover or push stations are set up, by means of which a transporting carriage can be pushed between one and the other rail track—or from a rail track off into a parked position. In this way, it is possible to introduce transporting carriages into the transport system, or remove them from it, according to need. This can be technically implemented e.g. by a track segment that can be pushed perpendicular to the direction of travel. As this kind of push station is arranged on each line head 9, the transporting carriages can be operated in a circulating system.

In order to alter the direction of motion of a transporting carriage on the path of travel, so-called turntables are preferably used, by means of which a transporting carriage on one can be turned, i.e. aligned, for onward travel in the direction of a connecting section of track.

Other embodiments provide a method for transporting metal coils, wherein the metal coils are transported by means of transporting carriages on a multi-track rail system, and comprises the following method steps:

- ascertainment of location information of each transporting carriage by means of a locating device;
- transfer of this location information to a central control device;
- generation of control information in order to control the drive device of a transportation carriage through the control device, wherein the location information of at least one of the transporting carriages located on the rail system is taken into consideration by the control device;
- establishment of a communication connection between the central control device and at least one communication device arranged on board;
- transmission of the control information from the control device to the at least one on-board communication device, wherein the transmission is carried out wirelessly at least in certain sections.

As the whereabouts of each transporting carriage of the rail system is continuously ascertained and the control device is fed, the transportation process can be controlled from a distance. In order to achieve control, the central control device transmits the appropriate control information to the mobile communication devices. In this way, the motion of the transporting carriages can be well adapted to the particular prevailing requirements. Should there be a build-up of the metal coils to be transported in the loading zone, for example, then transporting carriages in a parked position can be introduced into the rail system, and thereby the peak load is taken up by a temporary increase in the traffic density of the transporting carriages.

Other embodiments provide a driverless rail transporting carriage for transporting metal coils, in particular for transporting hot coils, which can be moved by means of a drive device on a multi-track rail system, wherein an on-board communication device is allocated to the transporting carriage, by means of which a communication connection can be established to a stationary control device, wherein this communication connection is embodied wirelessly at least in certain sections. The position of an individual transporting carriage on the rail system can be ascertained advantageously by means of a measuring device taken along on the transporting carriage in connection with a marker arranged on the line side. If the marker is coded in an absolute value, then complex determination of a reference point is superfluous. In other words, the transporting carriage knows at every point in time its current absolute whereabouts on the rail system and can transmit this location information to a center. The mobile radio connection between transporting carriage and stationary transmission and reception devices makes central control of the transportation process possible, which can be better adapted to unforeseen eventualities.

Radio communication is preferably carried out between an antenna of the on-board communication device and one or several leaky waveguides arranged on the line side. In order to avoid reflections off the leaky waveguide, it is closed off with a suitable load resistance. In order to protect the leaky waveguide as well as possible, it can be arranged in a tube or cable channel, for example in the foundation of the factory. Here, a covering that allows electromagnetic radiation to pass through it is preferred. In this way the leaky waveguide can also be put to use in a harsh industrial environment.

It can furthermore be beneficial if a special logical channel is allocated to each transporting carriage. This improves the efficiency of communication.

The communication advantageously takes place with the leaky waveguide in an industrial frequency range of 2.4 GHz or 5 to 6 GHz, which is provided for these kinds of uses.

FIG. 1 shows a simplified version of an example embodiment of the transporting system 1, which serves to transport metal coils 4. In a top-down view, a section of a line route of a track system 17 inside of a factory is shown, in which metal coils 4 are transported. The factory edge 28 is indicated in the drawing in FIG. 1 with a thin line.

A metal strip (not shown in detail) is fed (loading zone) onto each of two coiling devices 13 (down coilers) and wound into coils 4. These coils 4 are loaded onto transporting carriages 11 and transported away. The rail system 17 consists of or comprises two lines or rail tracks 24 and 25. Depending on loading status, the transporting carriages 11 are allocated to one of these rail tracks 24, 25. In the exemplary embodiment shown, the transporting carriages 11 travel when loaded on the rail track 24, and in an unloaded condition they travel on the rail track 25.

The following description begins with the coils being received on the vertical route section on the left of the picture in FIG. 1. A push station 26 that needs to be explained further, from where the line leads upwards to a first turntable 12, can be seen there. A horizontally-running track section joins on there. Along this horizontal track section, the route leads past various processing stations, such as e.g. an inspection station 15, a radial strapping 27 and a marking and weighing station 14. In the picture on the right of FIG. 1, the line then runs back in a vertical track section. The delivered metal coils are transported from this vertical track section by means of a crane 29 in one of the stores 18 (unloading zone). This second vertical track section ends again at a push station 26. By means of the push station 26, the circulating system of the transporting carriages 11 is closed.

Should, for example, a transporting carriage 11 be taken out of the transport system 1, then the transport process can be described as follows:

The metal coils 4 prepared by the winding device 13 are first loaded onto transporting carriages 11 on the rail track 24 and transported in the direction of the arrow 224. The first turntable 12 changes the vertically-running direction of transport into a horizontally-running one. The previously loaded metal coil is then transported on the lower, horizontally-running rail track 24 in FIG. 1 in the direction of the horizontal arrow 224, initially to the coil inspection 15. In order to keep the transport route free, the transporting carriage 11 with all the metal coils 4 lying on top of it is pushed downwards, perpendicular to the direction of transport 224. Analogously to this, the radial strapping 27 or the weighing of the metal coil 4 takes place in the station 14. Transporting carriages 11 that have arrived at the second turntable 12 (on the right in FIG. 1) undergo once more a change to their direction of travel; now in the present example the on-going route leads vertically down. The metal coil 4 is now transported on the rail track 24 that is on the right in FIG. 1 in the direction of the vertical arrow 224 pointing downwards. Two lifting devices 29 load the metal coil 4 transported there and bring it to an allocated store 18. At the end of the route section, the now empty transporting carriage 11 is pushed onto the second rail track 25. This is carried out by the push station 26 (moveable station) on the line head 9. In this way, the transporting carriage circulating system is closed again; the transporting carriage 11 is supplied again for the return journey. It now travels, empty, on the vertically-running track section 25 in the direction of the arrow 225 upwards, in the direction of the second turntable 12. After changing its direction of motion (horizontally-running section of the line in FIG. 1) in the direction of the arrow 225 from right to left to the first turntable 12, and from there after another change of the direction of travel, vertically downwards in the direction of the first push station 26. This first push station 26 places the unloaded transporting carriage 11 back onto the rail track 24 provided for loaded vehicles, where it can be once again loaded with a metal coil 4 prepared by the winding device 13. The transport system is thereby closed per se.

Driving of the transporting carriage 11 is carried out by a drive device 22 that may consist essentially of an electric motor 2 with all gears and control electronics, and is controlled by an on-board device 3 on the vehicle side. Energy input is carried out by means of a contact line 36 (see FIG. 4). The contact line 36 is installed along the line. These kinds of devices are known from rail vehicles and do not need to be further explained here. The on-board device 3 is equipped with a locating device 23 and a communication device 31. This locating device 23 will be explained in greater detail below.

In the present exemplary embodiment, the locating device 23 comprises a position sensor 34 that measures the absolute position of a transporting carriage 11 on the rail system 17. A reading head 32 arranged on the vehicle side (see FIG. 4) thereby optoelectronically scans a code rail 33 with an absolute path coding 8 that, together with the contact line 36, is arranged protected in a channel on the ground side along the line. In this way, the on-board device 3 always knows its current position.

The communication device 31 may consist essentially of a transmission and reception device with an antenna 30. This makes radio communication possible with stationary devices, the leaky waveguides 16, in a section 35. In the present example, the radio network 19 is embodied according to the Standard Industrial Wireless LAN for those with a leaky waveguide 16. As a leaky waveguide 16 the RCoax type is used, as is described in the 'simatic net' system handbook from Siemens A G, 2005. The leaky waveguide 16 is installed along the rail track 24 and 25 in each case. In this way, the current position of each transporting carriage 11 can be requested by the data network 20 or transmitted to the center 40 in the data network 20. In this way, the transportation process can be controlled from a distance on the rail system 17. I.e., the central control device 40 can transfer specified values of a travelling speed and/or acceleration or delay ramps or a specified position to the drive device of each transporting carriage 11. Other data available from the on-board device 3 can also be requested from there. Transporting carriages 11 can be diverted from the transport route and brought into a parked position, from where they can be reactivated as needed. In the case of disruption to a processing station, transporting carriages 11 can likewise be directed to another one that is intact. Overall, in this way the transporting system 1 is very flexible and can easily be adapted to prevailing production conditions with regards to circumstances on the transport route. The wireless data transfer between the communication device 31 on the vehicle side and the leaky waveguide 16 suffers no wear and tear. The leaky waveguide 16 can easily be accommodated in a protected channel. In this way, the leaky waveguide 16 is well protected against mechanical damage. The transmission frequency in the radio network 19 can preferably lie within the frequency ranges assigned for industrial purposes: 2.4 GHz and 5 to 6 GHz.

Figure 2:
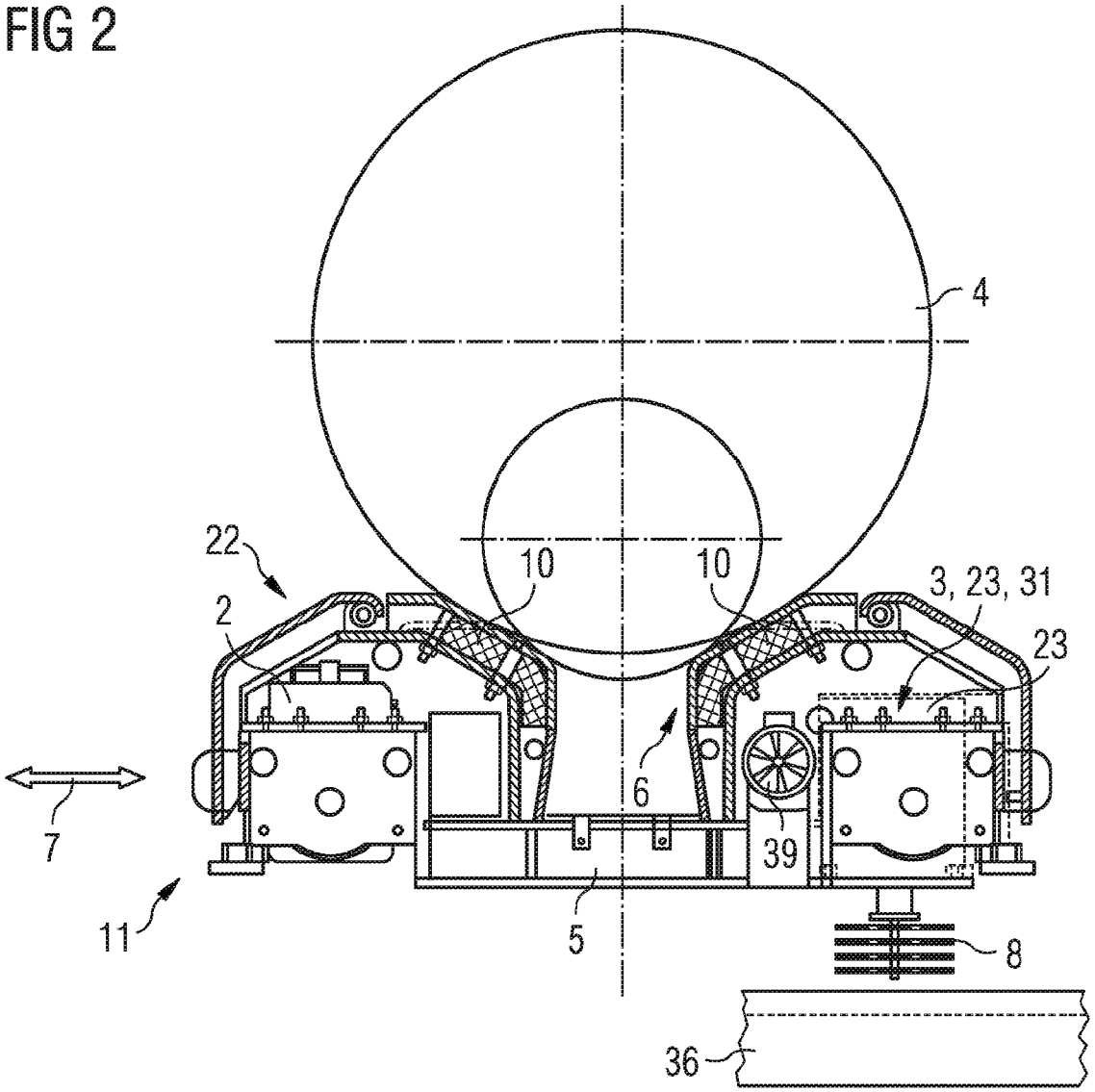
FIG. 2 a transporting carriage for transporting metal coils, which is equipped a mobile radio device and a locating device.

FIG. 2 shows a cross section of a transporting carriage 11 that is equipped with a vehicle chassis 5 with a support saddle 6 for transporting a metal coil 4, in particular for transporting a hot coil. This kind of metal or hot coil 4 can be of varying size. The transporting carriage 11 is correspondingly embodied. The transporting carriage 11 can be moved in the direction of the arrow 7 on the rail track system 17. As has already been described above, the transporting carriage 11 is equipped with devices for communication and navigation 3, 23 and 31. In order to protect the electric drive 2 with all control electronics and the on-board device 3 from heat build-up, the inclined face of the support saddle 6 facing the coil 4 is furnished with a heat shield 10, or formed from one. In addition, a ventilator 39 ensures adequate cooling of the electronic components.

Figure 3:
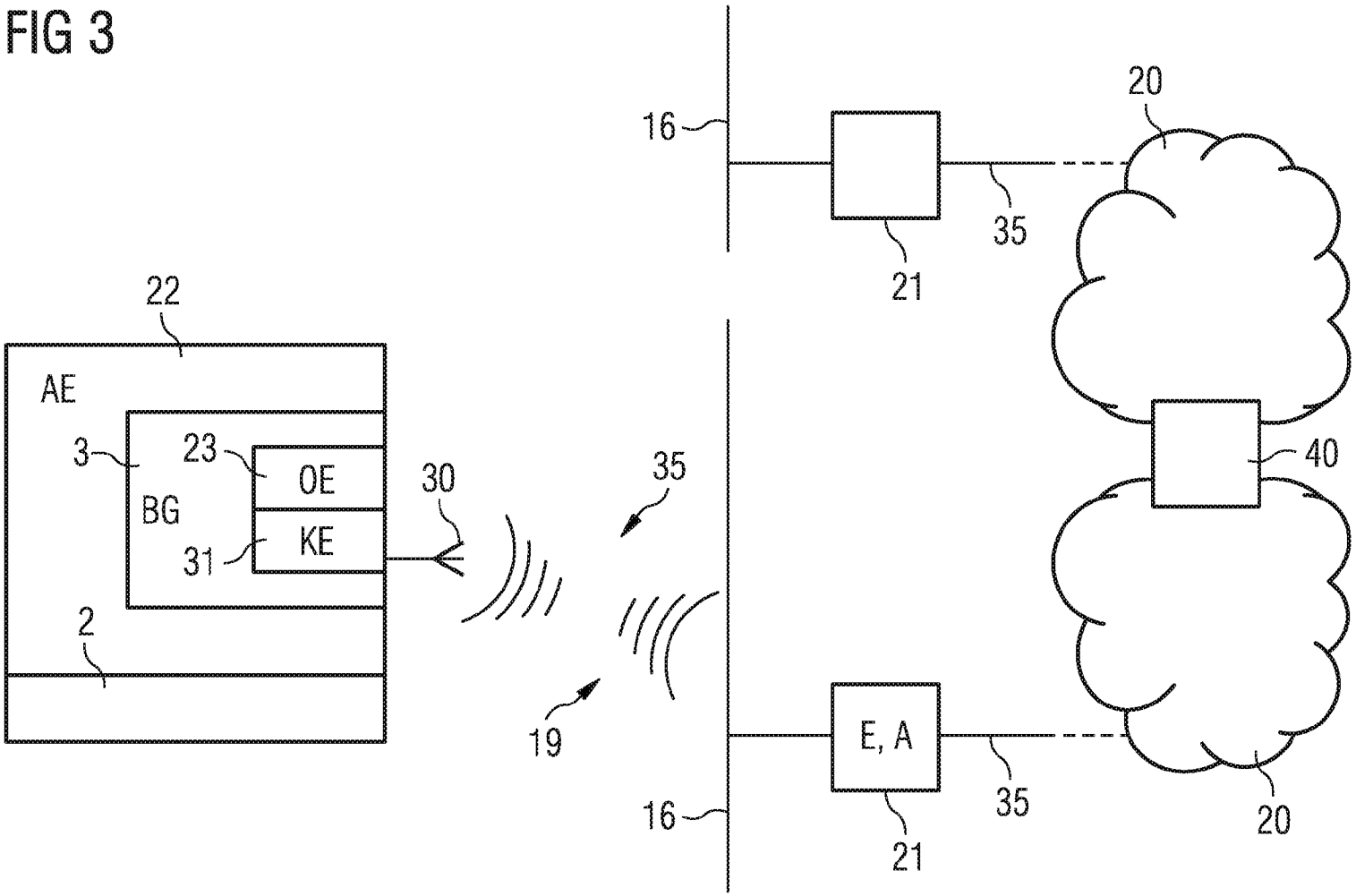
FIG. 3 a block diagram, which shows the drive and communication device on the vehicle side and the fixed leaky waveguide together with all the further attached communication equipment in a schematic depiction as an example.

As FIG. 3 once again shows in a block diagram, a drive device 22, an on-board device 3 with a locating device 23 and a communication device 31 is allocated to each transporting carriage 11. Data transfer to the leaky waveguide 16 installed on the base side is carried out by means of an antenna 30 via a radio interface 19. Each leaky waveguide 16 is closed off anechoically on one side and joined with a stationary base device 21. Connections that are not shown in any more detail connect every base device 21 with a central control unit 40 in the superordinate data network 20.

Figure 4:
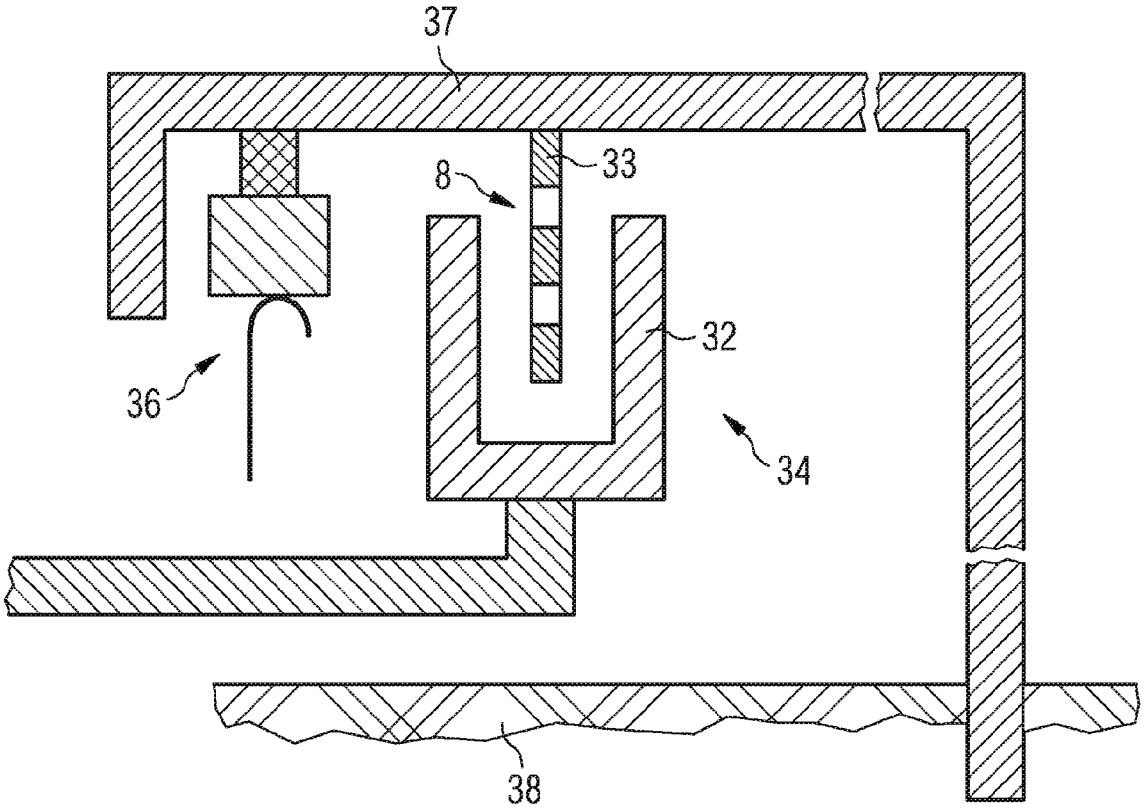
FIG. 4 a schematic depiction that shows an exemplary embodiment of the position-measuring device for measuring the absolute position of a rail transporting carriage in cross section.

FIG. 4 shows a cross section of a possible embodiment of the position sensor 34. The code rail 33 is fastened to a fixed mount 37. The mount 37 simultaneously serves as a covering and is anchored on the base side to the foundations 38. The reading head 32 is joined to the transporting carriage 11. It grips the code rail 33 from below and scans the code information of the code rail 33 through optoelectronic components that are not shown in detail. The code information is an absolute path coding 8 and is implemented in the form of interruptions to the code rail 33. The code information scanned at a particular point of the rail system 17 corresponds to an absolute position of the carriage 11. This is transmitted over the radio interface 19 to the leaky waveguide 16, possibly after signal processing. From there it reaches a displaced central control device 40 that coordinates the transport process. In FIG. 4, the contact line 36 is indicated by means of which energy input to the electric motor 2 of the transporting carriage 11 is carried out in a manner known per se.

Embodiments of the rail transport system may provide a range of advantages.

The communication possibilities according to at least some embodiments, in connection with the locating device, make it possible to control and supervise the transport process from a distance. In the case of a crisis, it is possible to intervene efficiently in the transport process. This increases the flexibility and availability of the transport system.

The two-track embodiment of the rail system creates the advantage that repeated lifting and laying down of the metal coil on the transport route is superfluous. A coil 4 is placed onto the carriage 11 in a loading zone after winding up (down coiler) 13 and only at the end is it removed in an unloading zone by means of a crane and brought into the coil store 18. That means that the coil 4 remains on the transporting device on which it was placed at the beginning of the transport. As a result, less damage occurs. Means of transportation that are constructed differently, and complex unloading such as in the prior art, are superfluous. Transport is fast and secure.

Adaptation of the transport service to increased need can be carried out in a simple manner through provision of additional transporting carriages 11 that are kept ready in a parked position that is not shown in more detail.

A further simplification results from the fact that for the rail system 17 the complex media technology (pneumatics, hydraulics) are superfluous, which above all means that for aggregates at a distance there is the advantage of being able to do without additional pump stations, valve stands or compressors or similar things in these locations.

A preferred use of the transport system or method described above is in the area of hot and cold rolling technology, in the area of metal sheets or aluminum. However, it is obvious that the use of the coil transport system described above is not limited to flat rolling material and sheet coils, but rather can be applied wherever there is a similar underlying problem.

LIST OF THE REFERENCE NUMERALS USED

1 Transporting system
2 Electric motor, drive unit
3 On-board device
4 Transported material, metal coil
5 Vehicle chassis
6 Support saddle
7 Direction of motion
8 Absolute path coding
9 Line head
10 Heat shield
11 Transporting carriage, coil transporting carriage
12 Turntable
13 Winder (down coiler)
14 Coil marking, weighing station
15 Coil inspection
16 Leaky waveguide
17 Rail system
18 Store (coil storage)
19 Communication connection, radio connection
20 Network

21 Base station (access point)
22 Drive device
23 Locating device
24 Tracks for coil transporting carriages with coil, first rail track
25 Tracks for empty coil transporting carriage, second rail track
26 Push station
27 Radial strapping
28 Factory edge
29 Lifting device, crane
30 Antenna
31 Communication device
32 Reading head
33 Code rail
34 Position sensor system
35 Wireless section of the communication connection
36 Contact line, contact rail
37 Mount, covering
38 Foundations
39 Ventilator
40 Central control device

What is claimed is:

1. A transporting system for transporting metal coils comprising:

a multi-track rail system;

several driverless transporting carriages configured for movement on the rail system by means of a drive device, each of the several driverless transporting carriages being equipped with at least one on-board communication device;

a locating device on each of the several driverless transporting carriages configured for continuously determining current location information for a respective one of the several driverless transporting carriages located on the multi-track rail system; and a central control device configured to receive continuously determined location information of each of the several driverless transporting carriages via the at least one on-board communication device on each of the several driverless transporting carriages, wherein a communication connection, including at least one wireless section, is established between the control device and each on-board communication device.

2. The transporting system of claim 1, wherein the communication connection is established via at least one leaky waveguide arranged on a side of a track of the multi-track rail system.

3. The transporting system of claim 2, wherein the at least one leaky waveguide is connected to a base station by means of electric connections.

4. The transporting system of claim 1, wherein the locating device comprises a portion of a position sensor.

5. The transporting system of claim 4, wherein the position sensor comprises the locating device which comprises a reading head arranged on a side of a respective one of the several driverless transporting carriages, and the position sensor further comprises a code rail arranged on a side of a track of the multi-track rail system.

6. The transporting system of claim 5, wherein the code rail is coded with an absolute path coding.

7. The transporting system of claim 1, wherein the multi-track rail system comprises a first rail track and a second rail track, loaded driverless transporting carriages are allocated to the first rail track, and unloaded driverless transporting carriages are allocated to the second rail track.

8. The transporting system of claim 1, further comprising a drive device for each of the several driverless transporting carriages, wherein the drive device is an electric motor controlled by power electronics, the energy provision of the electric motor being established by a contact line arranged on a side of a track of the multi-track rail system.

9. The transporting system of claim 7, further comprising at least one push station configured to push a driverless transporting carriage of the several driverless transporting carriages between the first rail track and the second rail track or from one of the first rail track and the second rail track into a parked position.

10. The transporting system of claim 7, further comprising at least one turntable configured to change a direction of motion of a driverless transporting carriage of the several driverless transporting carriages on one of the first rail track and the second rail track.

11. The method of claim 1, wherein the central control device allocates a logical channel to each on-board communication device of a driverless transporting carriage of the several driverless transporting carriages.

12. A method for transporting metal coils on a multi-track rail system by several driverless transporting carriages, each of the several driverless transporting carriages being driven by a drive device, the method comprising:

continuously determining current location information of each of the several driverless transporting carriages using a locating device;

transmitting the continuously determined current location information to a central control device;

generating control information to control the drive device using the central control device, the control information being generated based on the location information of at least one of the several driverless transporting carriages located on the multi-track rail system;

establishing a communication connection between the central control device and at least one communication device arranged on board of each of the several driverless transporting carriages; and transmitting the control information from the central control device to the at least one communication device arranged on board of each of the several driverless transporting carriages via the communication connection, which includes at least one radio connection.

13. The method of claim 12, wherein the communication connection is established via at least one leaky waveguide arranged on a side of a track of the multi-track rail system.

14. The method of claim 13, wherein the communication connection is established via at least one leaky waveguide, the at least one leaky waveguide being with attached to a base station.

15. The method of claim 12, wherein the locating device comprises a portion of a position sensor, the locating device moving along the tracks of the multi-track rail system.

16. The method of claim 15, wherein the location information of each of the several driverless transporting carriages is optoelectronically scanned using a reading head of the position sensor arranged on a side of a respective one of the several driverless transporting carriages, and a code rail of the position sensor arranged on a side of a track of the multi-track rail system, the locating device comprising the reading head.

17. The method of claim 16, wherein the reading head scans the code rail, the code rail being coded with an absolute path coding.

18. The method of claim 12, wherein the multi-track rail system comprises a first rail track and a second rail track, loaded transporting driverless carriages are allocated to the first rail track, and unloaded driverless transporting carriages are allocated to the second rail track.

19. The method of claim 18, further comprising using at least one push station to push a driverless transporting carriage of the several driverless transporting carriages between the first rail track and the second rail track or from one of the first rail track and the second rail track into a parked position.

20. The method of claim 12, wherein an electric motor, controlled by power electronics, is used as the drive device, the energy of the electronic motor being conveyed by means of a contact line arranged on a side of a track of the multi-track rail system.

21. Several driverless transporting carriages for transporting metal coils, each of the several driverless transporting carriages being driven by a drive device on a multi-track rail system, each of the several driverless transporting carriages comprising:

an on-board device comprising a locating device, configured to continuously determine current location information of the respective one of the several driverless transporting carriages, and at least one on-board communication device, wherein each on-board communication device is configured for data transfer via a communication connection including at least one wireless section.

22. The several driverless transporting carriages as claimed in claim 21, wherein the at least one wireless section is configured for radio communication with a leaky waveguide arranged on a side of a track of the multi-track rail system.

23. The several driverless transporting carriages as claimed in claim 21, wherein the at least one wireless section operates in a frequency range of 2.4 GHz or 5 to 6 GHz.

24. The several driverless transporting carriages as claimed in claim 21, each of the several driverless transporting carriages further comprising a vehicle chassis with a support saddle for transporting a metal coil and a heat shield arranged on the support saddle to protect the respective on-board device against heat build-up.

* * * * *